US007004793B2

(12) United States Patent
Scherer et al.

(10) Patent No.: US 7,004,793 B2
(45) Date of Patent: Feb. 28, 2006

(54) LOW INDUCTANCE SHIELDED CONNECTOR

(75) Inventors: Richard J. Scherer, Austin, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/833,836

(22) Filed: Apr. 28, 2004

(65) Prior Publication Data

US 2005/0245133 A1 Nov. 3, 2005

(51) Int. Cl.
*H01R 13/648* (2006.01)

(52) U.S. Cl. ..... 439/610; 439/578; 439/608

(58) Field of Classification Search ..... 439/578, 439/585, 608, 610, 108, 101
See application file for complete search history.

(56) References Cited

U.S. PATENT DOCUMENTS

| | | | | |
|---|---|---|---|---|
| 3,587,028 | A | 6/1971 | Uberbacher | |
| 4,088,385 | A | 5/1978 | Adkins | |
| 5,184,965 | A | 2/1993 | Myschik et al. | |
| 5,269,703 | A | 12/1993 | Ikegami | |
| 5,618,202 | A | 4/1997 | Okuyama et al. | |
| 5,632,634 | A | 5/1997 | Soes | |
| 5,766,036 | A | 6/1998 | Ahmad et al. | |
| 5,775,924 | A | 7/1998 | Miskin et al. | |
| 5,788,519 | A | 8/1998 | Stern | |
| 5,830,010 | A | 11/1998 | Miskin et al. | |
| 6,203,369 | B1 | 3/2001 | Feldman | |
| 6,231,391 | B1 | 5/2001 | Ramey et al. | |
| 6,239,373 | B1 | 5/2001 | Sato et al. | |
| 6,347,948 | B1 * | 2/2002 | Hwang | 439/92 |
| 6,358,088 | B1 * | 3/2002 | Nishio et al. | 439/596 |
| 6,371,813 | B1 | 4/2002 | Ramey et al. | |
| 6,471,549 | B1 * | 10/2002 | Lappohn | 439/608 |
| 6,494,744 | B1 * | 12/2002 | Lee | 439/610 |
| 6,527,587 | B1 * | 3/2003 | Ortega et al. | 439/608 |
| 6,709,290 | B1 * | 3/2004 | Yoshida | 439/585 |
| 6,743,057 | B1 * | 6/2004 | Davis et al. | 439/701 |
| 6,749,464 | B1 * | 6/2004 | Obata | 439/610 |
| 6,776,629 | B1 * | 8/2004 | Shuey | 439/108 |

FOREIGN PATENT DOCUMENTS

| | | | |
|---|---|---|---|
| EP | 0074205 | B1 | 3/1983 |
| EP | 0131248 | B1 | 1/1985 |
| EP | 0341535 | B1 | 11/1989 |
| EP | 0 562 691 | A1 | 9/1993 |
| EP | 0 907 225 | A2 | 4/1999 |
| WO | WO 94/11926 | A1 | 5/1994 |

OTHER PUBLICATIONS

Search Report for PCT/US2005/011418.

* cited by examiner

*Primary Examiner*—Gary Paumen
(74) *Attorney, Agent, or Firm*—Melanie G. Gover

(57) ABSTRACT

An electrical connector system includes mating header and socket connectors. The header connector includes a plurality of signal pins and a plurality of shield blades. The socket connector including an electrically insulative carrier containing a plurality of electrical cable connectors. Each of the cable connectors comprises an electrically conductive outer housing containing an electrically insulative inner housing. The inner housing holds at least one conductive terminal in electrical isolation from the outer housing for making electrical connection between a cable signal conductor and a signal pin of the header connector. The inner housing includes a cavity for receiving one of the plurality of shield blades of the header connector, and the outer housing includes a contact for electrically coupling with the shield blade.

38 Claims, 7 Drawing Sheets

LOW INDUCTANCE SHIELDED CONNECTOR

BACKGROUND

This invention relates to electrical connectors, and particularly to low inductance, high-speed electrical connectors for attachment of electrical signal transmission cables to printed circuit boards.

Conductors carrying high frequency signals and currents are subject to interference and cross talk when placed in close proximity to other conductors carrying high frequency signals and currents. This interference and cross talk can result in signal degradation and errors in signal reception. Shielded cables are available to carry signals from a transmission point to a reception point, and reduce the likelihood that the signal carried in one shielded or coaxial cable will interfere with the signal carried by another shielded or coaxial cable in close proximity. However, at points of connection, such as connection to a printed circuit board, the shielding for the signal is often lost, thereby allowing interference and crosstalk between signals. The use of individual shielded wires and cables is often not desirable at points of connection due to the need for making a large number of connections in a very small space. In these circumstances, two-part high-speed electrical connectors containing shielded conductive paths are used.

In high-speed electrical connectors containing shielded conductive paths, it is desirable to provide a stable impedance profile for each of the signal conductors in the connector. Instabilities in the impedance profile will introduce undesirable distortions in the transmitted signal, and a stable impedance profile becomes of increasing importance as frequencies and currents increase. Instabilities in the impedance profile may result from, for example, failure of a ground path associated with a signal conductor, or an insufficient ground path between two signal conductors. A high-speed electrical connector having improved reliability of shielding for high frequency signals and currents is needed.

SUMMARY

The invention described herein provides a high-speed electrical connector for attachment of electrical signal transmission cables to printed circuit boards. In one embodiment according to the invention, the connector comprises a first terminal configured for electrical connection to a first signal conductor of a cable, and a second terminal configured for electrical connection to a second signal conductor of the cable. An electrically insulative inner housing is configured to maintain the first and second terminals in electrical isolation from each other, and also includes a cavity for receiving a first mating ground contact therein. An electrically conductive outer housing receives the inner housing and first and second terminals, and also electrically couples with a shield of the cable. The outer housing includes a contact for electrically coupling with the first mating ground contact received in the cavity of the inner housing.

In another embodiment according to the invention, an electrical socket connector comprises an insulative carrier configured to engage a header connector. Positioned within the carrier is at least one cable connector terminating a corresponding cable. Each cable connector comprises a conductive outer housing electrically connected to a shield of the corresponding cable. The outer housing has therein an insulative inner housing holding first and second conductive terminals in electrical isolation from each other and the outer housing. The terminals are connected at one end to signal conductors of the corresponding cable. The inner housing is configured for receiving a shield blade between the first and second terminals. The outer housing includes a first contact for electrically coupling with the shield blade received between the first and second terminals, a second contact for electrically coupling with a second shield blade on an exterior surface of the outer housing, and a third contact for electrically coupling with a third shield blade on an exterior surface of the outer housing.

In another embodiment according to the invention, an electrical connector system comprises a header connector having a header body with a plurality of signal pins and a plurality of shield blades extending therefrom. A socket connector including an electrically insulative carrier is configured for engagement with the header body. The carrier contains a plurality of electrical cable connectors. Each of the plurality of cable connectors comprises an electrically conductive outer housing containing an electrically insulative inner housing. The inner housing holds at least one conductive terminal in electrical isolation from the outer housing. The inner housing includes a cavity for receiving one of the plurality of shield blades of the header connector, and the outer housing includes a contact for electrically coupling with the shield blade.

In another embodiment according to the invention, an electrical connector assembly comprises at least one electrical signal transmission cable, the at least one cable having at least one signal conductor. A socket connector comprising an insulative carrier contains at least one cable connector. The at least one cable connector comprises a conductive outer housing having therein an insulative inner housing. The inner housing holds a first conductive terminal in electrical isolation from the outer housing. The first terminal is connected at one end to a first signal conductor of the at least one cable and has a first contact at an opposite end. The inner housing includes a cavity for receiving a shield blade therein, and the outer housing including a first contact for electrically coupling with the shield blade received in the inner housing.

DETAILED DESCRIPTION

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
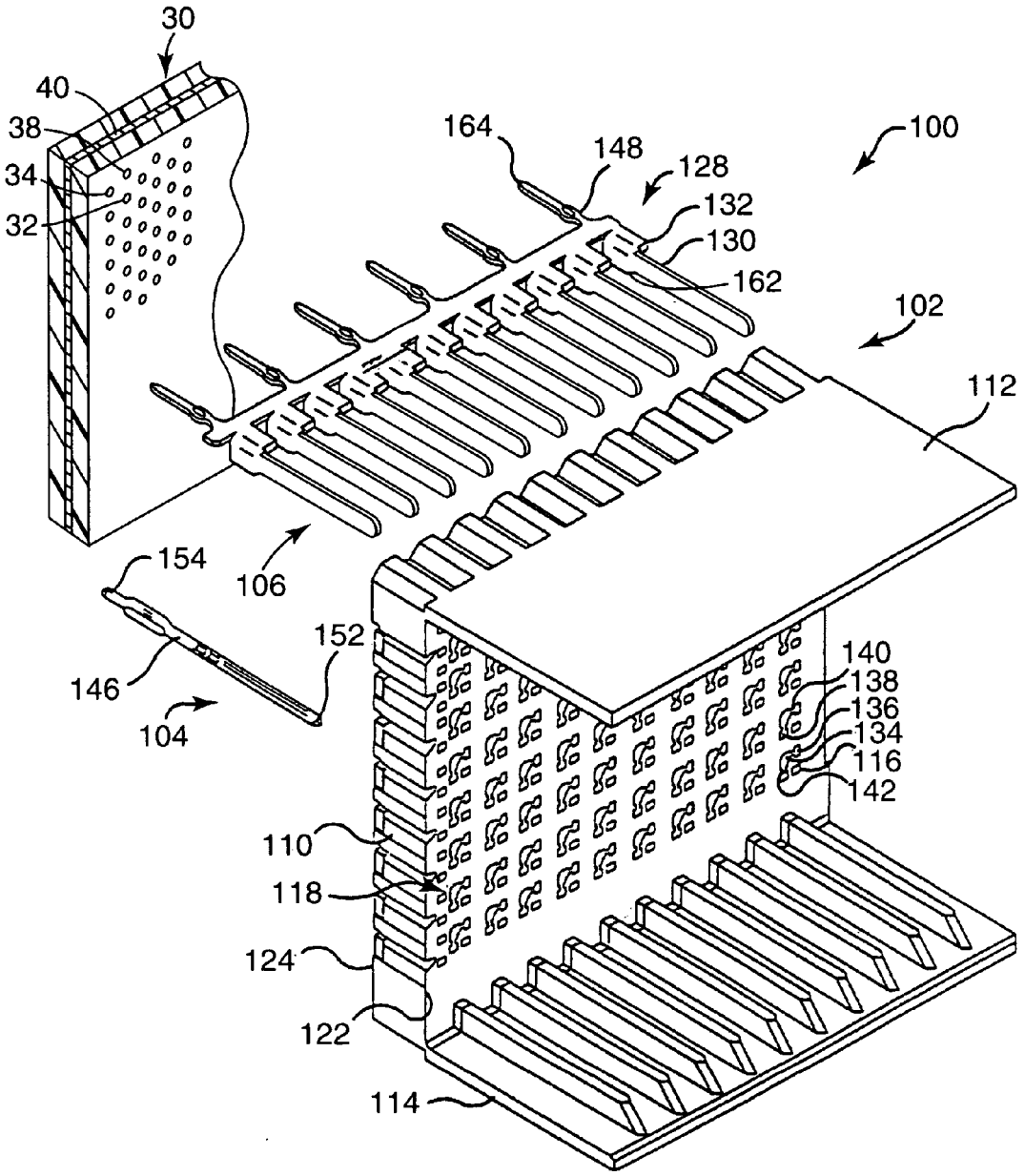
FIG. 1 is an exploded perspective view of a header connector in accordance with the invention having an array of male pin contacts and shield blades.
Figure 2:
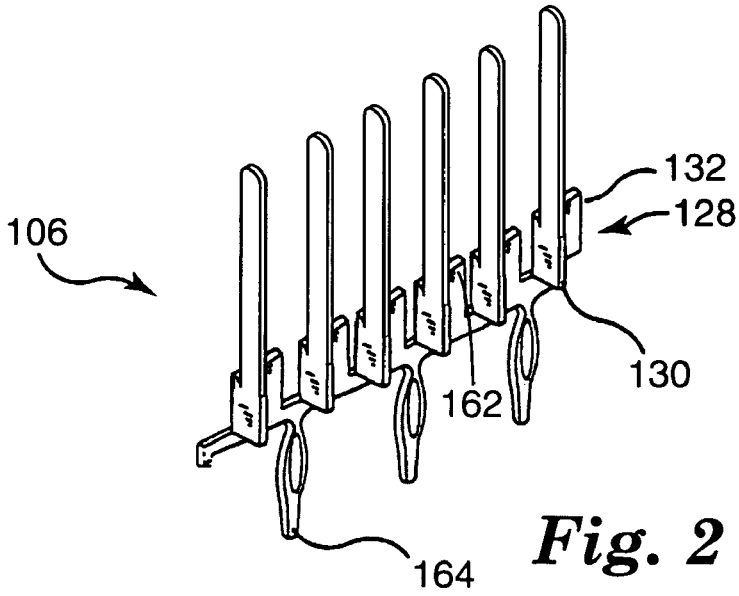
FIG. 2 is a perspective view of the continuous strip of shield blades of FIG. 1.
Figure 3:
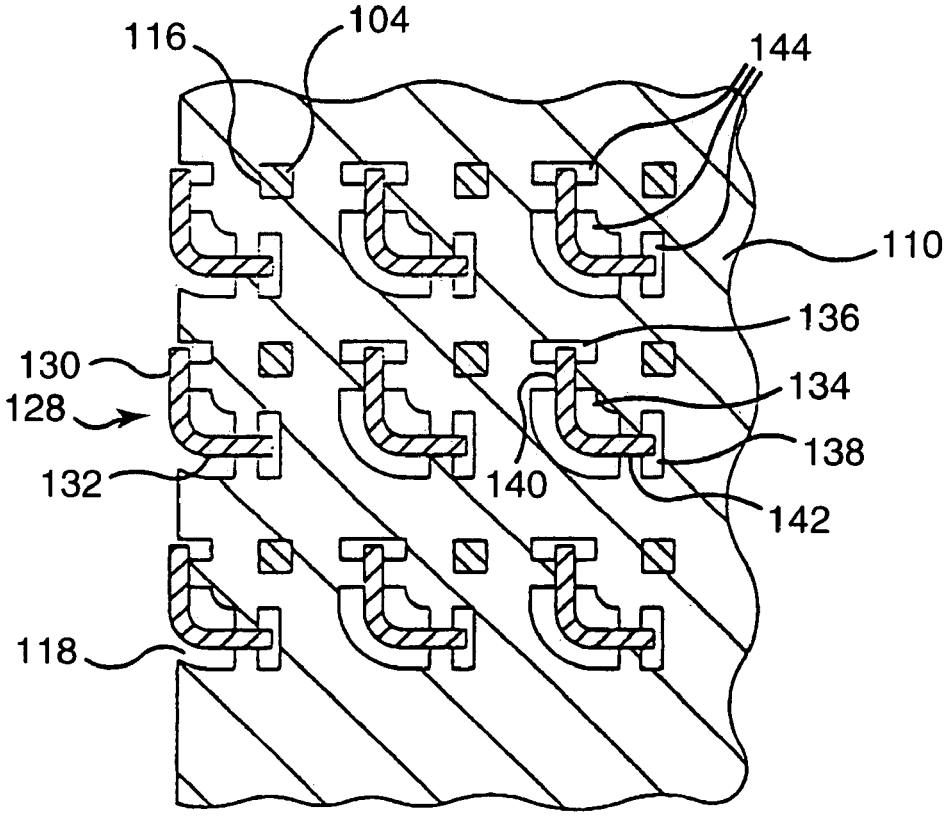
FIG. 3 is a cross-sectional view of the front wall of the header connector showing signal pins surrounded by right angle portions of the shield blades forming coaxial shields around each signal pin.

FIGS. 1, 2, and 3 show a header connector 100 for use with a low inductance shielded connector in accordance with the present invention. The header connector 100 is configured for attachment to a printed circuit board 30 and connection to a mating socket connector 200 (shown in FIG. 4). The header connector 100 includes a header body 102, a plurality of signal pins 104, and a continuous strip of material having a plurality of shield blades 106 formed therein. The header body 102 is formed to include a vertical front wall 110, and top and bottom laterally-extending, horizontal walls 112 and 114 projecting perpendicularly therefrom. The front wall 110 is formed to include a plurality of first signal-pin-receiving openings 116, and a plurality of second shield-blade-receiving openings 118, all of which extend between an internal surface 122 and an external surface 124 of front wall 110. The plurality of second shield-blade-receiving openings 118 are formed to have a generally right angle cross-section. The openings 116, 118 may include chamfered entrances at one or both of internal surface 122 and external surface 124 to assist in the insertion of pins 104 and shield blades 106.

The plurality of signal pins 104 are configured for insertion into the plurality of first signal-pin-receiving openings 116 in the header connector 100 to form an array of signal pins 104 which are configured for reception in an array of signal pin-insertion windows 250 in mating socket connector 200 (shown in FIG. 6), when the socket connector 200 is inserted into the header connector 100. Each signal pin 104 includes a first end 152 extending above the front wall 110 of the header connector 100, and a second end 154 spaced apart from the first end 152 and configured for insertion into an opening 32 in printed circuit board 30.

The plurality of shield blades 106 are each formed to include a generally right angle shielding portion 128 configured to be inserted into the plurality of second, generally right angle shield-blade-receiving openings 118. The generally right angle shielding portion 128 of each of the plurality of shield blades 106 includes substantially perpendicular first leg portion 130 and second leg portion 132. Each shield blade 106 includes a first end 162. The generally right angle shielding portion 128 preferably extends to internal surface 122 of the front wall. When inserted into header body 102, the first end 162 of shield blade 106 extends above the plane of internal surface 122 of the front wall 110 of the header connector 100, adjacent to a signal pin 104. Each strip of shield blades 106 also includes at least one shield tail 148. The number of shield tails 148 may be the same as the number of shield blades 106, or may be different than the number of shield blades 106. A second end 164 of each shield tail 148 is spaced apart from the first end 162 and configured for insertion into a hole 34 in the printed circuit board 30 adjacent to the second end 154 of the signal pin 104. In one embodiment, tails 148 of shield blades 106 are electrically connected to a ground plane 40 within printed circuit board 30. In a preferred embodiment shield blades 106 are commonly grounded. In an alternate embodiment, shield blades are not commonly grounded. In another alternate embodiment, at least one signal pin 104 is electrically connected with ground plane 40 and commonly grounded with at least shield blade 106 via the ground plane.

As shown in FIG. 3, the first signal-pin-receiving openings 116 and the second shield-blade-receiving openings 118 are arranged symmetrically in the front wall 110 of the header body 102 such that the generally right angle shielding portions 128 of shield blades 106 substantially surround the signal pins 104 to form a coaxial shield around each of the plurality of signal pins 104. Each of the plurality of second, generally right angle shield-blade-receiving openings 118 includes a central portion 134 coupled to first and second end portions 136 and 138 by first and second narrowed throat portions 140 and 142. The first and second narrowed throat portions 140 and 142 are dimensioned to frictionally engage the first and second leg portions 130 and 132 of the shield blades 106 to hold the shield blades 106 in place. The central portion 134 and the first and second end portions 136 and 138 of each of the plurality of second generally right angle openings 118 are formed to provide air gaps 144 surrounding the generally right angle shield portion 128 of a shield blade 106. The geometry and dimensions of the air gaps 144, the geometry, dimensions and material of the right angle shielding portions 128, and the geometry, dimensions and material of the header body 102 surrounding the air gaps 144 are configured to tune the header connector 100 to match a specified impedance (for example, 50 ohms). The configuration of the right angle shield blades 106 lends itself to mass production in a continuous strip in a manner that economizes material usage.

Each of the plurality of signal pins 104 includes a pin tail 146, and each strip of shield blades 106 includes at least one shield tail 148. The number of shield tails 148 may be the same as the number of shield blades 106, or may be different than the number of shield blades 106. In a preferred embodiment, each strip of shield blades 106 has a plurality of shield tails 148, with one shield tail 148 for every two shield blades 106, wherein the shield tails 148 are staggered and aligned with alternate shield blades 106 along the strip of shield blades 106. In alternate embodiments, other ratios of shield tails 148 to shield blades 106 may be provided, with the shield tails 148 either uniformly or non-uniformly spaced along the length of the strip of shield blades 106. Embodiments having staggered shield tails 148 on shield blades 106 are particularly useful in back-to-back mounting of header connectors 100 on a printed circuit board, as the staggered shield tails 148 permit back-to-back mounting of header connectors 100 without interference between shield tails 148 of the opposing header connectors 100. In preferred embodiments, pin tails 146 and shield tails 148 are positioned in an evenly spaced matrix, such that back-to-back mounted header connectors may be mounted orthogonally to each other. When the signal pins 104 and shield blades 106 are inserted into the front wall 110 of the header body 102, the pin tails 146 and the shield tails 148 extend outwardly from the external surface 124 of the front wall 110. The pin tails 146 and shield tails 148 of header 100 can be either press fitted into the holes 32, 34 in the printed circuit board 30 or soldered thereto. Alternatively, the pin tails 146 and shield tails 148 could instead be surface mounted to the printed circuit board 30.

Figure 4:
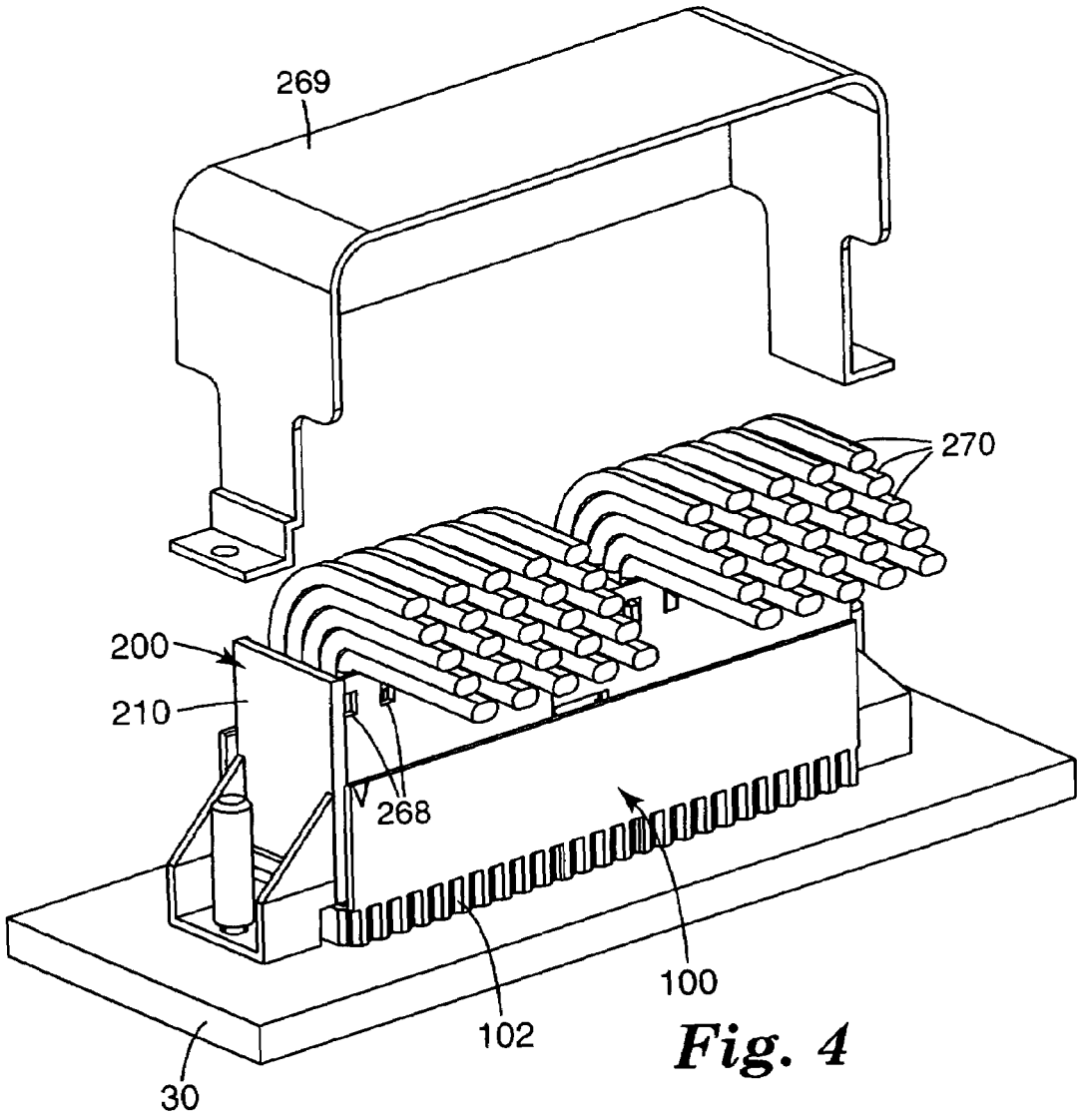
FIG. 4 is a perspective view showing a socket connector according to the invention mated with a header connector of FIGS. 1–3.
Figure 6:
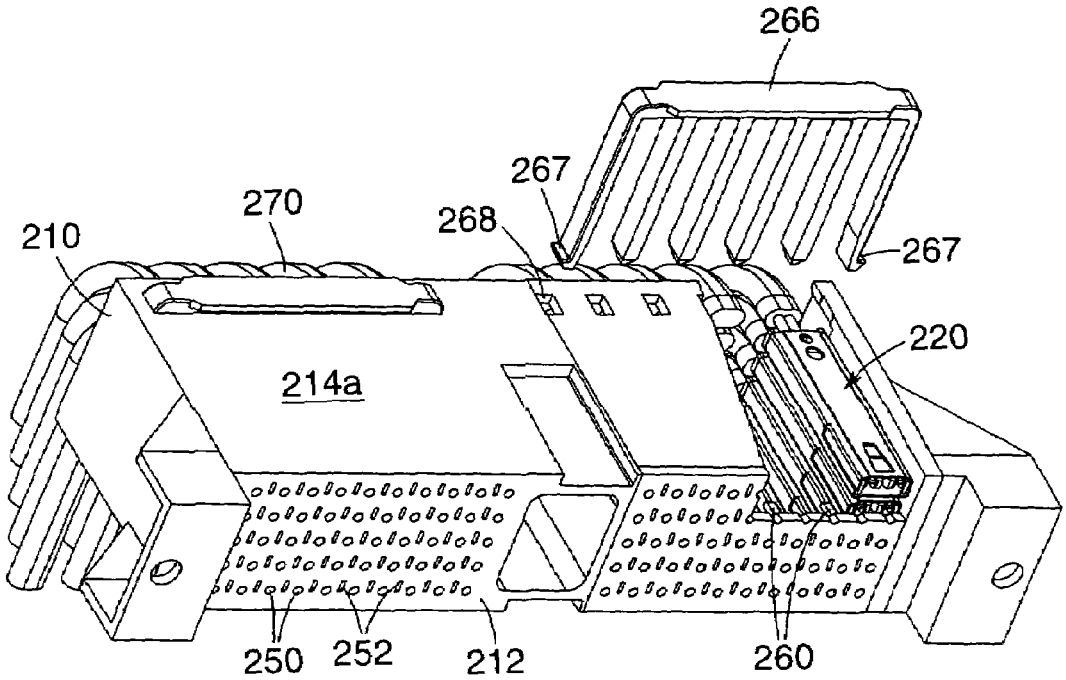
FIG. 6 is a perspective view showing the mating face of the socket connector of FIG. 4.
Figure 7:
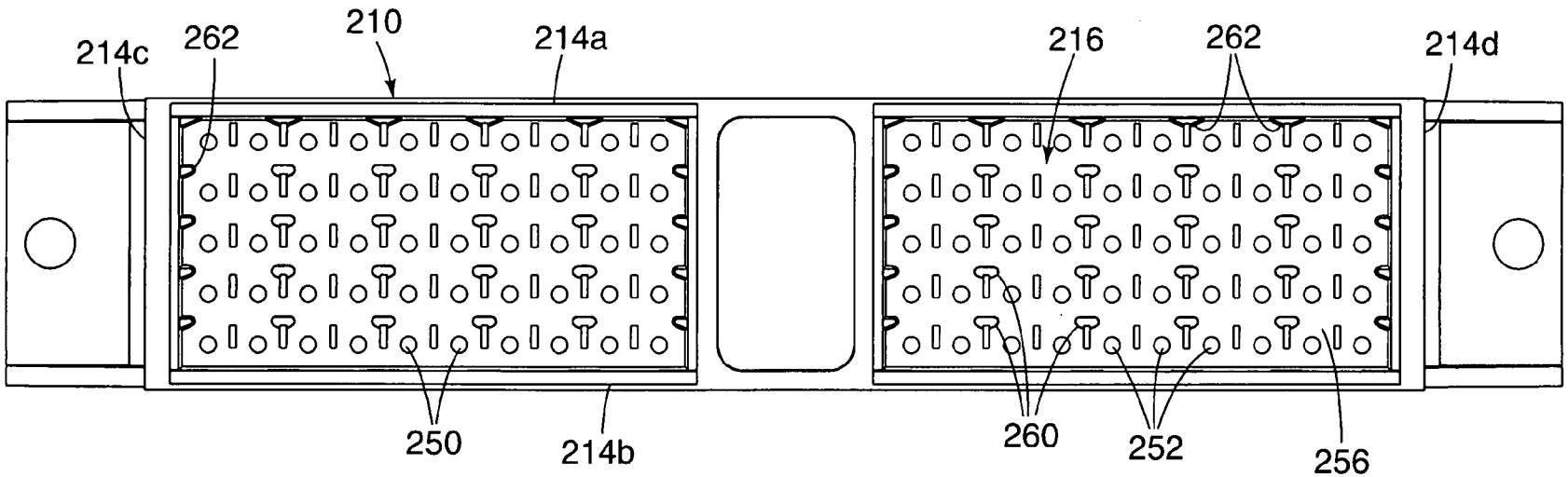
FIG. 7 is a top view of the socket carrier of FIG. 6, with the cable connectors removed from the carrier.

One embodiment of socket connector 200 is illustrated in FIG. 4, as socket connector 200 is mated with header 100. Socket connector 200 includes an insulative carrier 210 configured to mate with header body 102. As best seen in FIGS. 6 and 7, insulative carrier 210 includes a front wall 212, and four laterally-extending side walls 214*a*, 214*b*, 214*c*, 214*d* projecting perpendicularly therefrom. Front wall 212 and side walls 214*a*, 214*b*, 214*c*, 214*d* define an interior 216 of carrier 210. In one embodiment according to the invention, header 100 and socket connector 200 are configured according to industry standard IEC 61076-4-101. In each embodiment, at least one, and typically a plurality of individually replaceable cable connectors 220 are positioned within the interior of carrier 210, with each cable connector 220 terminating a corresponding signal transmission cable 270. The cables 270 may be, for example, coaxial or twin-axial cables. For improved performance, the cables are preferably shielded cables. However, the cable connectors 220 are also suitable for use with unshielded cables 270.

Figure 5A:
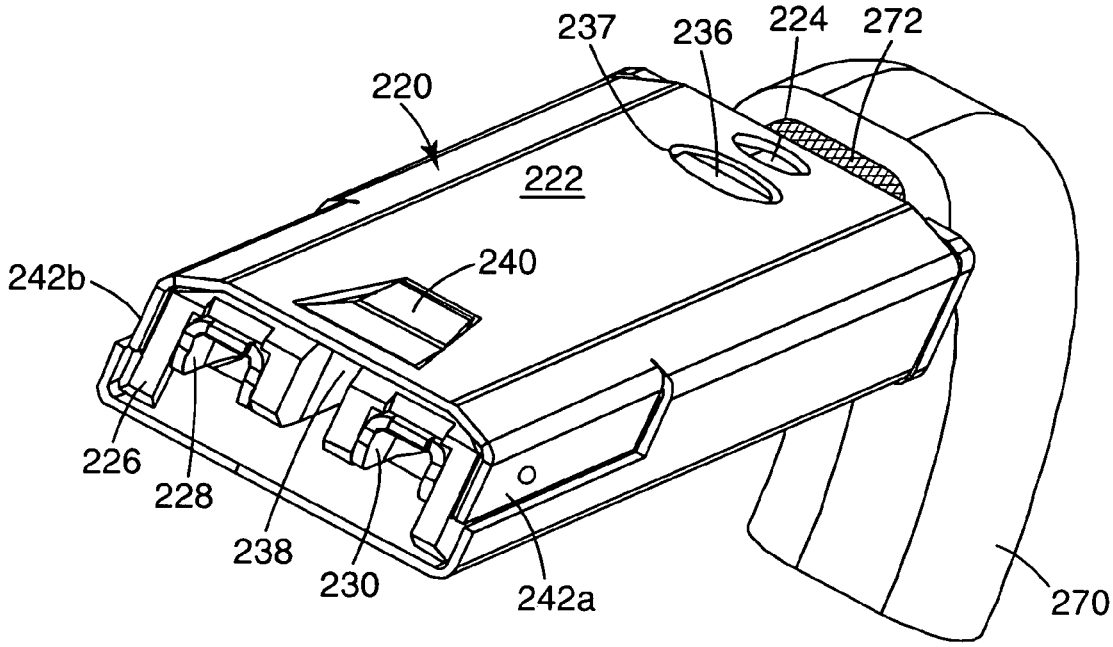
FIG. 5*a* is a perspective view showing an individual cable connector used in the socket connector of FIG. 4.
Figure 5B:
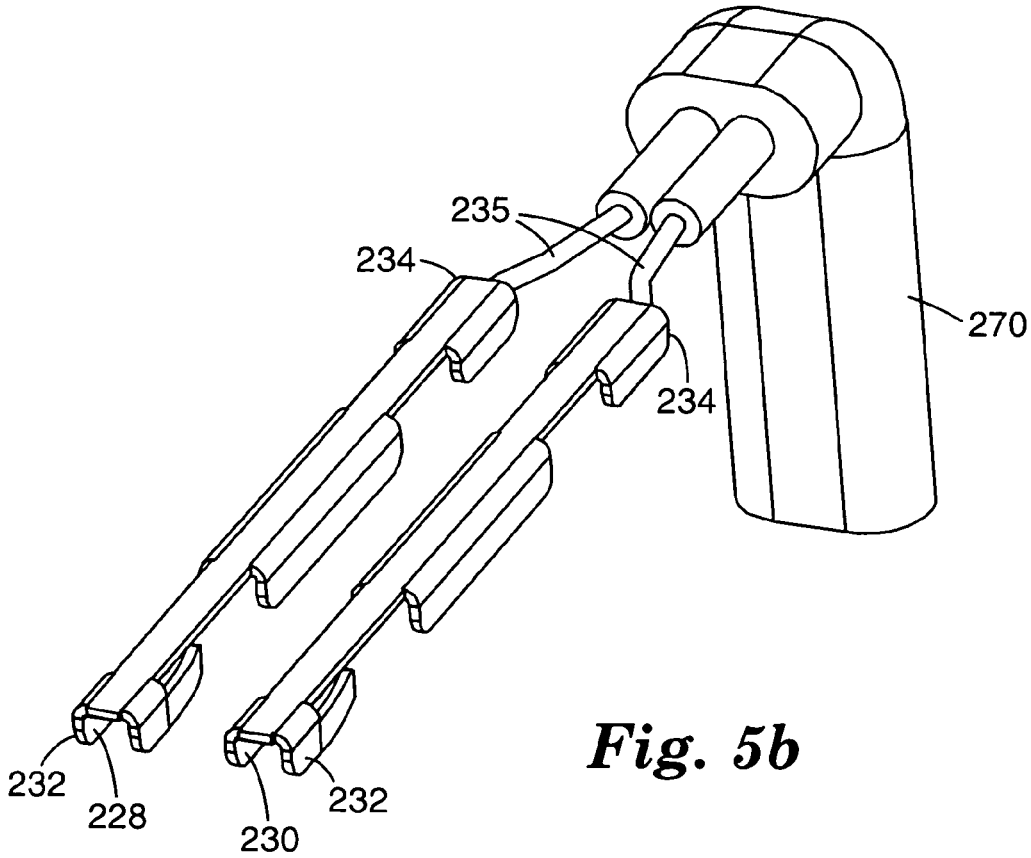
FIG. 5*b* is a perspective view of the cable connector of FIG. 5*a*, with the outer and inner housings removed.

As best seen in FIGS. 5*a* and 5*b*, the cable connectors 220 each include a conductive outer housing 222. When used with shielded cables, the conductive outer housing 222 is electrically connected to the shield 272 of the corresponding cable 270, such as by soldering the outer housing 222 to a shield braid of the cable using solder hole 224 in housing 222. The outer housing contains an insulative inner housing 226 that is configured to hold a first conductive terminal 228 and a second conductive terminal 230 in electrical isolation from each other and from the outer housing 222. Although the illustrated embodiment includes only first and second conductive terminals 228, 230, it will be appreciated that additional conductive terminals may be included without departing from the invention. For example, in other embodiments each cable connector may include 3, 4, 5 or more conductive terminals. Alternately, the cable connectors 220 contained in insulative carrier 210 may have differing numbers of conductive terminals. Each terminal 228, 230 is configured at a first end 232 (adjacent front or mating end of the connector 220) to make electrical connection with a signal pin 104 of header 100. The first end 232 may be configured in any suitable manner to make connection with pin 104, including beams, bumps, dimples, or other resiliently deflectable structures. Each terminal 228, 230 is configured at a second end 234 (opposite first end 232 and near a back end of the connector 220) to make electrical connection with a conductor 235 of the corresponding cable 270. The second end 234 may be configured in any suitable manner to make connection with the conductor 235 of cable 270, such as by soldering or crimping. The conductors of the corresponding cable 270 may be signal conductors or ground conductors, depending upon the particular application. In the illustrated embodiment of FIGS. 5*a* and 5*b*, after terminals 228, 230 have been connected to signal conductors 235 of cable 270, terminals 228, 230 are inserted in inner housing 226 and the inner housing 226 is slidably inserted into the back end of outer housing 222, until the inner and outer housings 226, 222, respectively, are secured in snap fitting engagement by the interaction of protrusion 236 on inner housing 226 and hole 237 in outer housing 222.

The inner housing 226 includes an opening 238 adjacent the front end of the cable connector 220. The opening 238 is configured for receiving a shield blade 106 of the header 100 between the first and second terminals 228, 230. The conductive outer housing 222 includes a first contact 240 for electrically coupling with the shield blade 106 received in the opening 238 between the first and second terminals 228, 230. In other embodiments, the outer housing 222 includes at least one contact 242 on an exterior surface 244 of the outer housing 222 for electrically coupling with another shield blade 106 of the header 100. In the illustrated embodiment of FIG. 6, a second contact 242*a* and a third contact 242*b* are provided on the exterior surface 244 of the outer housing 222 for electrically coupling with a second and third shield blades 106 of the header 100. The contacts 242*a*, 242*b* on the exterior surface 244 of the outer housing 222 are preferably slightly recessed from the outermost circumference of outer housing 222, to provide room for shield blade 106 between immediately adjacent cable connectors 220. The contacts of the outer housing 222 may be of any suitable design, including beams, bumps, dimples, or other resiliently deflectable structures. In alternate embodiments having more than two terminals, inner housing 226 is provided with additional openings 238, such that an opening 238 for receiving a ground blade 106 is provided between all adjacent terminals. For example, a cable connector having three terminals would have two openings, a cable connector having four terminals would have three openings, and so on.

The individual cable connectors 220 are positioned and retained within the interior 216 of insulative carrier 210, as best illustrated in FIGS. 6 and 7. The front wall 212 of carrier 210 is formed to include a plurality of signal-pin-receiving openings 250, and a plurality of shield-blade-receiving openings 252, all of which extend between the external surface 254 and the internal surface 256 of front wall 212. The openings 250, 252 are positioned such that they correspond to the positions of terminals 228, 230 and ground contacts 242, 242*a*, 242*b* of the cable connectors 220 when the cable connectors 220 are positioned in the carrier 210. The plurality of signal-pin-receiving openings 250 are formed to have a generally circular cross-section, while the plurality of shield-blade-receiving openings 252 are formed to have a generally rectangular cross-section. The openings 250, 252 may have other cross-sectional profiles, depending upon the cross-sectional shape of the mating signal pins 104 and shield blades 106. The openings 250, 252 may include chamfered entrances at external surface 254 to assist in the insertion of pins 104 and shield blades 106.

Positioning posts 260 extend from internal surface 256 of front wall 212, and are shaped and spaced from each other such that individual cable connectors 220 (shown in dashed lines in FIG. 7) are removably retained within carrier 210. Additional positioning features 262 may be provided on the interior surface of one or more side walls 214*a*, 214*b*, 214*c*, 214*d* to aid in positioning and retaining cable connectors 220. After all of the cable connectors 220 are loaded into carrier 210, cable connectors 220 are secured in carrier 210 by a retention clip 266. Retention clip 266 is inserted through openings 268 in side walls 214*a*, 214*b* of carrier 210 in a direction transverse to the insertion direction of cable connectors 220, such that retention clip 266 is positioned behind cable connectors 220. Retention clip 266 preferably is releasably secured to carrier 210, such as by resilient latch arms 267, so that retention clip 266 may be removed, if necessary, to repair or replace one or more cable connectors 220.

As shown in FIG. 4, a cable shroud 269 is also preferably engaged with the carrier 210. The cable shroud 269 protects and guides the cables 270 as they exit the carrier 210. In one embodiment, cable shroud 268 guides cables 270 at an angle to the engagement direction of the socket connector 200, such that a low profile connection is provided. In one low profile system, cable should 269 guides cables 270 in a right bend, where the bend radius is approximately equal to or less than ten times the cable diameter.

Figure 8:
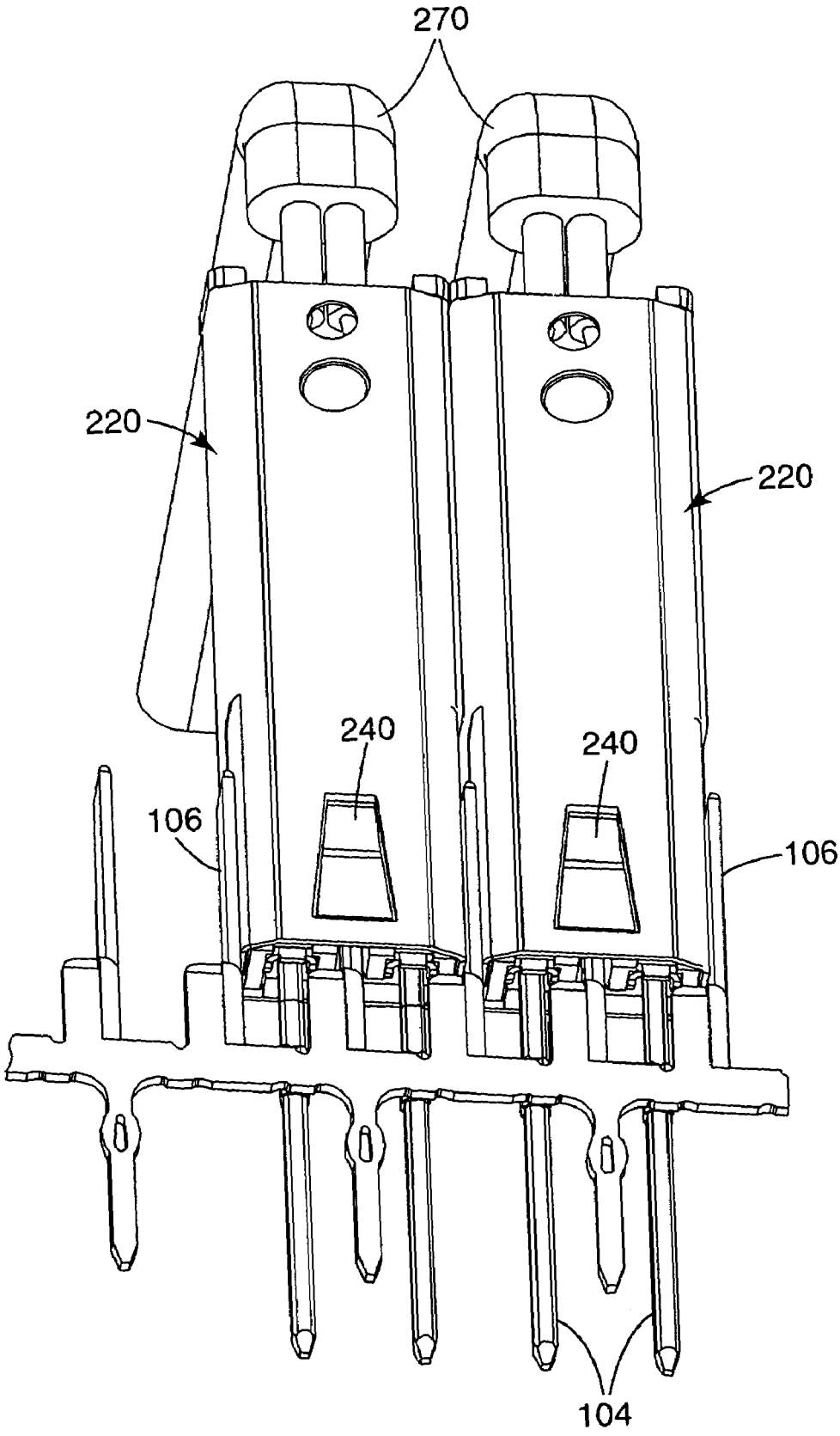
FIG. 8 is an illustration of the cable connectors, signal pins and shield blades of the mated socket connector and header connector of FIG. 4.

The interaction of individual cable connectors 220 with the signal pins 104 and shield blades 106 of header 100 that occurs when header 100 and socket 200 are engaged is best seen in FIG. 8, in which only the cable connectors, signal pins 104 and shield blades 106 are illustrated. As clearly seen in FIG. 8, signal pins 104 are received by terminals 228, 230 within cable connectors 220, while shield blades 106 are received in openings 238 between adjacent terminals within each connector 220, and also in recessed areas between adjacent cable connectors 220. The shield blades 106 in recessed areas between adjacent cable connectors 220 are in electrical engagement with both cable connectors 220. In the illustrated embodiments, adjacent terminal/ground pins are each separated by a ground path. However, in other embodiments according to the invention, ground paths need not be provided between every adjacent terminal/ground pin. The multiple ground paths provided in the connector system afford the connector system with a stable impedance profile. In particular, because of the multiple ground paths in the connector system, the effect on the impedance profile of the connector as a whole and of individual signal conductors caused by the failure of a single ground path is reduced or minimized.

All plastic parts of header connector 100 and socket connector 200 are molded from suitable thermoplastic material, such as liquid crystal polymer ("LCP"), having the desired mechanical and electrical properties for the intended application. The conductive metallic parts are made from, for example, plated copper alloy material, although other suitable materials will be recognized by those skilled in the art. The connector materials, geometry and dimensions are all designed to maintain a specified impedance throughout the part.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector system comprising:

a header connector comprising a header body having a plurality of signal pins and a plurality of shield blades extending therefrom; and a socket connector comprising an electrically insulative carrier configured for engagement with the header body, the carrier containing a plurality of electrical cable connectors, each of the plurality of cable connectors comprising an electrically conductive outer housing having therein an electrically insulative inner housing, the inner housing holding at least one conductive terminal in electrical isolation from the outer housing, the at least one terminal configured at one end for engagement with one of the plurality of signal pins, the inner housing including a cavity for receiving a first one of the plurality of shield blades therein, the outer housing including a first contact for electrically coupling with the first one of the plurality of shield blades.

2. The electrical connector system of claim 1, wherein the outer housing further includes a second contact for electrically coupling with a second one of the plurality of shield blades.

3. The electrical connector system of claim 1, wherein the conductive outer housing of each of the plurality of cable connectors is configured to electrically couple with a shield of a cable.

4. The electrical connector system of claim 1, wherein the at least one terminal is configured for electrical connection to a cable signal conductor at an end of the terminal opposite the end configured for engagement with one of the plurality of signal pins.

5. The electrical connector system of claim 2, wherein the second contact is configured to electrically couple with a second one of the plurality of shield blades on an exterior surface of the outer housing.

6. The electrical connector system of claim 1, wherein the at least one conductive terminal comprises:

a first terminal configured for electrical connection between a first of the plurality of signal pins and a first signal conductor of a cable; and a second terminal configured for electrical connection between a second of the plurality of signal pins and a second signal conductor of the cable.

7. The electrical connector system of claim 6, wherein the cavity of the inner housing is positioned between the first and second terminals.

8. The electrical connector system of claim 2, wherein the outer housing further includes a third contact for electrically coupling with a third of the plurality of shield blades on an exterior surface of the outer housing.

9. The electrical connector system of claim 8, wherein the second and third contacts of the outer housing are positioned on opposite sides of the outer housing.

10. The electrical connector system of claim 8, wherein the first terminal is positioned between the first contact and second contact of the outer housing, and wherein the second terminal is positioned between the first contact and the third contact of the outer housing.

11. The electrical connector system of claim 2, wherein the first contact of the outer housing comprises an inwardly projecting element extending at least partially into the cavity of the inner housing, and wherein the second contact of the outer housing comprises an outwardly projecting element.

12. The electrical connector system of claim 1, wherein each of the plurality of shield blades has a generally right angle shielding portion configured to be disposed adjacent to a corresponding one of the plurality of signal pins.

13. The electrical connector system of claim 12, wherein the plurality of signal pins and plurality of shield blades are arranged in the header body such that the generally right angle shielding portions of the plurality of shield blades substantially surround the plurality of signal pins to form a coaxial shield around each of the plurality of signal pins.

14. The electrical connector system of claim 1, wherein the plurality of shield blades, are formed in a continuous strip of material.

15. The header connector of claim 14, wherein the continuous strip of material forming the plurality of shield blades further comprises at least one tail configured for engagement with a printed circuit board.

16. An electrical connector assembly comprising:

at least one electrical signal transmission cable, the at least one cable having at least one signal conductor; and a socket connector comprising an insulative carrier containing at least one cable connector, the at least one cable connector comprising a conductive outer housing, the outer housing having therein an insulative inner housing, the inner housing holding a first conductive terminal in electrical isolation from the outer housing, the first terminal connected at one end to a first signal conductor of the at least one cable and having a first contact at an opposite end, the inner housing including a cavity for receiving a shield blade therein, the outer housing including a first contact for electrically coupling with the shield blade received in the inner housing.

17. The electrical connector of claim 16, wherein the outer housing includes a second contact for electrically coupling with a second shield blade on an exterior surface of the outer housing.

18. The electrical connector assembly of claim 17, further comprising a second conductive terminal in electrical isolation from the first conductive terminal and the outer housing, the second conductive terminal connected at one end to a second signal conductor of the at least one cable and having a second contact at an opposite end.

19. The electrical connector assembly of claim 17, wherein the outer housing further comprises a third contact for electrically coupling with a third shield blade on an exterior surface of the outer housing.

20. The electrical connector assembly of claim 19, wherein the cavity of the inner housing is positioned between the first and second terminals, and wherein the second and third contacts are positioned on opposite sides of the first and second terminals, respectively, from the cavity.

21. The electrical connector assembly of claim 16, wherein the cable is a coaxial cable.

22. The electrical connector assembly of claim 18, wherein the cable is a twinaxial cable.

23. An electrical socket connector comprising:

an insulative carrier configured to engage a header connector;

at least one cable connector positioned in the carrier, each cable connector terminating a corresponding cable, each cable connector comprising a conductive outer housing electrically connected to a shield of the corresponding cable, the outer housing having therein an insulative inner housing, the inner housing holding first and second conductive terminals in electrical isolation from each other and the outer housing, the first terminal connected at one end to a first signal conductor of the corresponding cable and the second terminal connected at one end to a second signal conductor of the corresponding cable, the inner housing configured for receiving a shield blade between the first and second terminals, the outer housing including a first contact for electrically coupling with the shield blade received between the first and second terminals, a second contact for electrically coupling with a second shield blade on an exterior surface of the outer housing, and a third contact for electrically coupling with a third shield blade on an exterior surface of the outer housing.

24. The electrical socket connector of claim 23, further comprising a retention clip to secure the at least one electrical connector in the carrier.

25. The electrical socket connector of claim 23, further comprising a cable shroud engaged with the carrier.

26. The electrical socket connector of claim 25, wherein the cable shroud guides the cables at an angle to an engagement direction of the socket connector.

27. The electrical socket connector of claim 26, wherein the cables have a bend radius equal to or less than ten times the diameter of one of the cables.

28. The electrical socket connector of claim 23, further comprising a plurality of cable connectors, wherein each of the plurality of cable connectors are individually replaceable within the carrier.

29. An electrical connector for terminating an electrical signal transmission cable, the connector comprising:

a first terminal configured for electrical connection to a first signal conductor of a cable;

a second terminal configured for electrical connection to a second signal conductor of the cable;

an electrically insulative inner housing configured to receive the first and second terminals in electrical isolation from each other, the inner housing including a cavity for receiving a first mating ground contact therein;

an electrically conductive outer housing configured to receive the inner housing, first terminal and second terminal therein and electrically couple with a shield of the cable, the outer housing including a first contact for electrically coupling with the first mating ground contact.

30. The electrical connector of claim 29 wherein the outer housing further includes a second contact for electrically coupling with a second mating ground contact.

31. The electrical connector of claim 30, wherein the outer housing further includes a third contact for electrically coupling with a third mating ground contact.

32. The electrical connector of claim 29, wherein the inner housing receives the first mating ground contact between the first and second terminals.

33. The electrical connector of claim 29, wherein the first contact of the outer housing comprises an inwardly projecting element extending at least partially into the cavity of the inner housing.

34. The electrical connector of claim 30, wherein the second contact of the outer housing comprises an outwardly projecting element.

35. The electrical connector of claim 31, wherein the first contact of the outer housing comprises an inwardly projecting element and the second and third contacts of the outer housing comprise outwardly projecting elements.

36. The electrical connector of claim 30, wherein the first and second contacts of the outer housing are resiliently deflectable structures selected from the group consisting essentially of beams, bumps, and dimples.

37. The electrical connector of claim 29, wherein the outer housing receives the inner housing, first terminal and second terminal at a first end thereof, and electrically couples with the first and second mating ground contacts adjacent a second end thereof.

38. The electrical connector of claim 29, wherein the electrically conductive outer housing is configured to make electrical contact with an electrical shield of the cable.

* * * * *

UNITED STATES PATENT AND TRADEMARK OFFICE

CERTIFICATE OF CORRECTION

PATENT NO. : 7,004,793 B2
APPLICATION NO. : 10/833836
DATED : February 28, 2006
INVENTOR(S) : Scherer, Richard J.

It is certified that error appears in the above-identified patent and that said Letters Patent is hereby corrected as shown below:

Column 6,
Line 61, delete "right" and insert -- right-angle --.

Signed and Sealed this

Twentieth Day of June, 2006

JON W. DUDAS
*Director of the United States Patent and Trademark Office*